United States Patent [19]

Michael et al.

[11] 4,123,804

[45] Nov. 7, 1978

[54] GLOVE POCKETS

[76] Inventors: Joseph Michael, 103 McAvoy Ave.; Louis R. Siringo, 8102 Buena Vista Dr., both of Rome, N.Y. 13440

[21] Appl. No.: 756,935

[22] Filed: Jan. 5, 1977

[51] Int. Cl.[2] ..... A41D 27/20
[52] U.S. Cl. ..... 2/247
[58] Field of Search ..... 2/247, 145, 115, 253, 2/160

[56] References Cited

U.S. PATENT DOCUMENTS

| | | | |
|---|---|---|---|
| 2,883,673 | 4/1959 | Solomon | 2/253 |
| 3,174,156 | 3/1965 | Dale et al. | 2/115 |

*Primary Examiner*—Doris L. Troutman
*Attorney, Agent, or Firm*—David H. Semmes; Warren E. Olsen

[57] ABSTRACT

A pocket for garments defined by a half-glove or half-mitten sewn to the exterior or interior of a pair of trousers, so as to define a hand engaging concavity. The pocket may be in the form of a regular glove with particulate finger portions or a mitten and may be sewn, as well, to garments such as a shirt, blouse or skirt.

3 Claims, 10 Drawing Figures

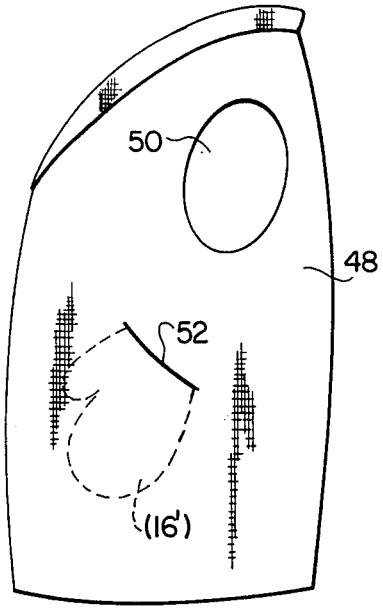
FIG. 7
FIG.10
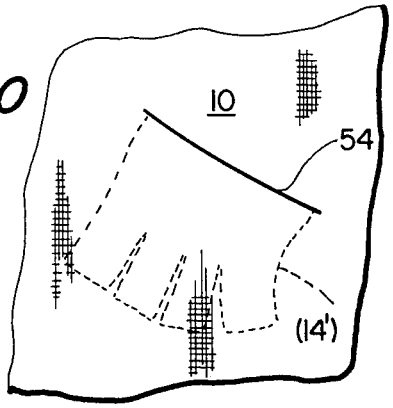
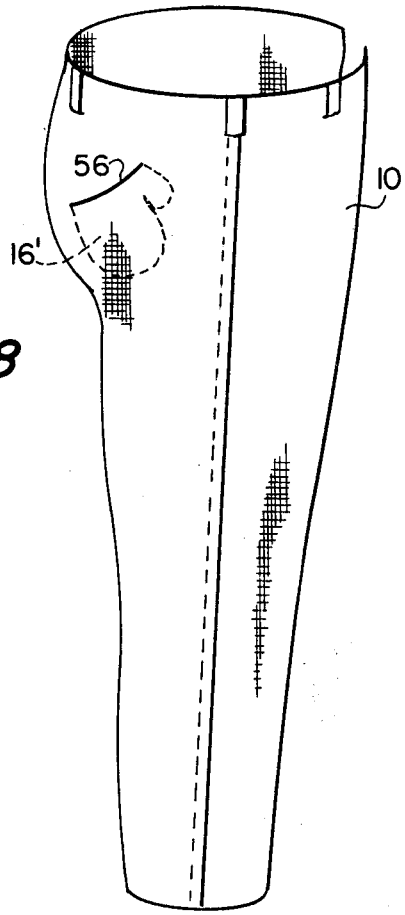
FIG. 8
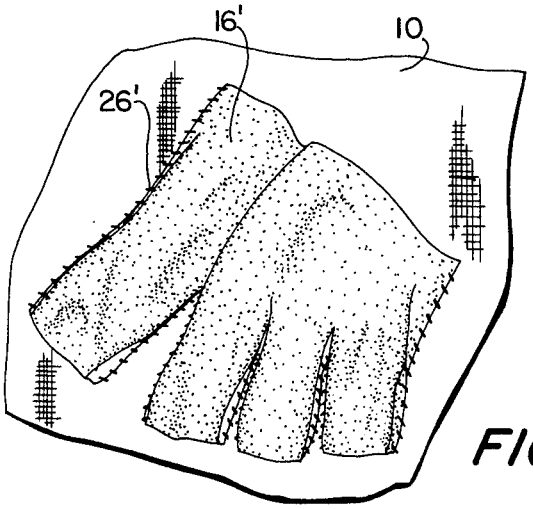
FIG. 9

GLOVE POCKETS

BACKGROUND OF THE INVENTION

1. Field of the Invention

Garment pockets, particularly decorative pockets formed as a concavity complementally engageable with the human hand. According to contemporary teenage codes, young couples frequently walk side-by-side with their hands in each other's rear pocket. The present invention which has been designated as a "Love Pocket" may be in the form of a half-glove with particulate finger portions or a half-mitten, so as to form a concavity upon the exterior garment which is complementally engageable with the human hand.

2. The Prior Art

Investigation has been conducted by professional searcher Meyer Perlin in the following classes:

Class 2, Subclasses 227, 247–250, 253
Design D 2, Subclasses 28, 368, 229

The following prior patents are noted:
Lipshitz U.S. Pat. No. 2,614,260
Horwitz U.S. Pat. No. 2,991,239
Tworoger U.S. Pat. No. 2,224,752
Lipshie U.S. Pat. No. 2,077,153
Rothman U.S. Pat. No. 1,725,306
Reiss U.S. Pat. No. 1,711,541

These patents suggest, of course, pockets which are superposed upon a garment to allow entry of the hand. However, none of the patents suggest the placement of rear-mounted pockets, particularly formed in a glove or mitten shape, whereby a person other than the wearer may insert his or her hand while both are walking in a side-by-side fashion. Horwitz illustrates a web (A) which forms a pocket external to an inner pocket (B). However, this outer pocket construction is not adapted as an assessory which may be placed independently of the first pocket, but rather is innerconnected with the material which forms the inner pocket too.

The remaining pockets illustrate multiple pocket constructions. Tworoger illustrates a mitten-like pocket which is integrally formed within a jacket; yet not adapted to be added upon the posterior of a pair of jeans or the like. Rothman illustrates another pocket construction which is integrally formed within an existing pocket on a pair of trousers. The Rothman constructions requires that it be formed as a part of the garment during its manufacture.

SUMMARY OF THE INVENTION

According to the present invention, a glove-like or mitten-like accessory pocket may be formed upon the posterior of a pair of jeans or upon a garment blouse, skirt or the like. The pocket is in the form of half-glove or half-mitten and may be sewn directly, for example upon the conventional rear pockets of jeans or may be sewn independently of the conventional pocket upon the garment's inner or outer surface. The pocket may be sewn, also, to the inner side of the garment and may be accessible by means of a slit formed in the garment adjacent the glove or mitten opening, such that the human hand may be placed through the slit and inside the garment to engage the hand conformed concavity.

DESCRIPTION OF THE DRAWINGS

FIG. 2 is an elevation showing securement of the glove configuration to the exterior of a T-shirt of the like;

FIG. 7 is an elevational view of an inner half-mitten configuration accessible by means of a slit formed in the garment side;

FIG. 8 is an elevation showing a half-mitten configuration secured to the inner side of a jeans posterior and accessible by means of slit in the rear of the jeans;

FIG. 9 is a half-glove configuration affixed to a fabric of the type used in manufacture of garments, carrying bags, boxes, and the like.

FIG. 10 is a fragmentary view, similar to FIG. 7, showing securement of the half-glove configuration to the inner side of the garment and accessible by means of a slit.

DESCRIPTION OF PREFERRED EMBODIMENT

Figure 1:
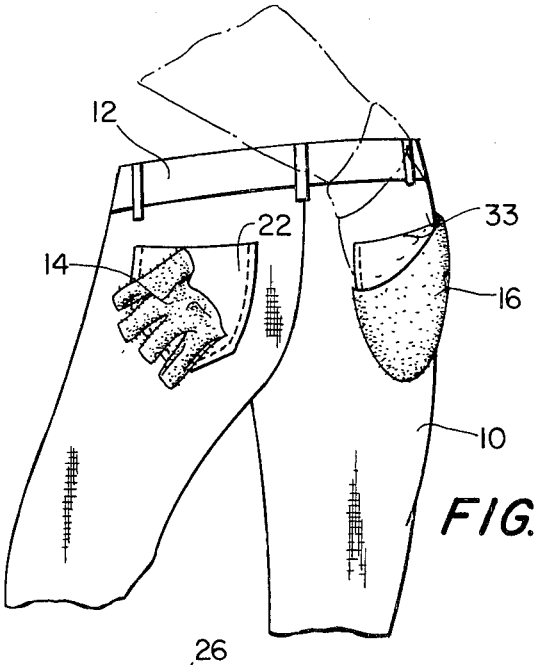
FIG. 1 is a fragmentary rear perspective, showing a pocket of glove configuration and a pocket of mitten configuration secured to the rear pockets of a conventional pair of jeans.

In FIG. 1 a conventional pair of "blue" jeans 10 is illustrated as being supported by a conventional belt 12 and having conventional left rear pocket 22 and right rear pocket 38. A half glove 14 is sewn by means of stitches 26 to the rear of pocket 22 and the rear of the jeans, so as to define a hand-engaging concavity having articulate, open ended finger portions, or outer stall portions 32, 34, 36 and 38.

Figure 4:
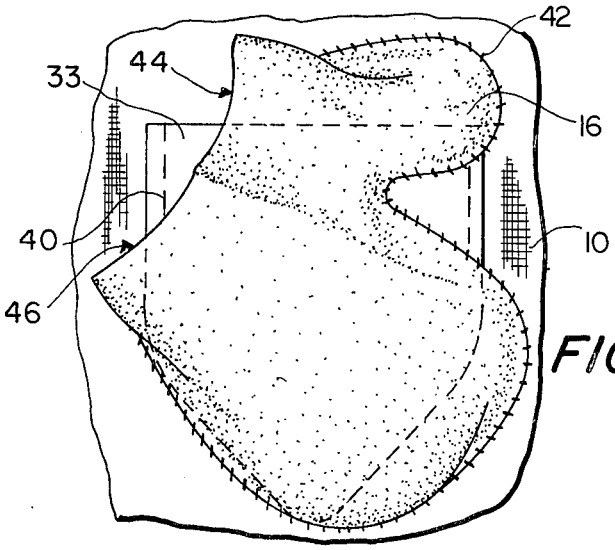
FIG. 4 is a fragmentary rear elevation showing securement of the half-mitten configuration, illustrated in FIG. 1.
Figure 6:
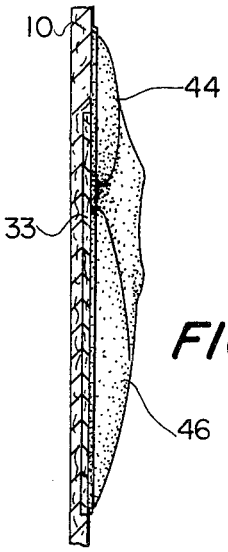
FIG. 6 is a side elevation of the half-mitten configuration, illustrated in FIGS. 1 and 4.

Similarly a half-mitten configuration 16, as illustrated in FIGS. 1 and 4 is sewn to the rear pocket 38, such that the open thumb portion 44 and hand portion 46 are angularly disposed with respect to the rear of the pocket. Pocket 38, of course, may be stitched to the jeans by means of conventional stitching 40 and pocket 22 may be stitched by means of conventional stitching 24. As illustrated in FIG. 1, a person other than the wearer of jeans 10 and walking side-by-side with the wearer may insert his hand in either the half-mitten configuration 16 or the half-glove configuration 14.

Figure 2:
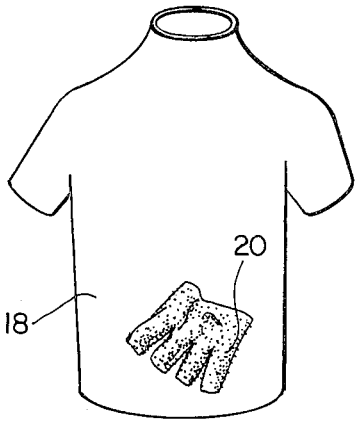
Figure 3:
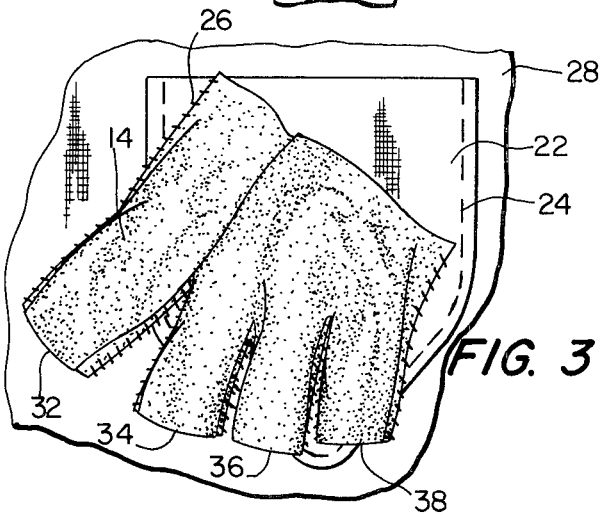
FIG. 3 is an enlarged fragmentary rear elevation, showing securement of the half-glove configuration, as in FIG. 1.
Figure 5:
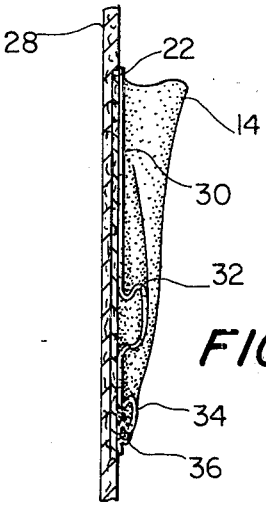
FIG. 5 is a side elevation of the half-glove configuration, illustrated in FIGS. 1 and 3.

FIG. 2 illustrates the half-glove configuration 20 sewn to the exterior of a conventional T-shirt 18 or the like.

FIG. 7 illustrates a further modification of invention wherein the half-mitten configuration (shown in phantom) is stitched to the interior of a blouse 48, having a conventional arm aperture 50. The half-mitten 16' is accessible from the exterior of the garment by means of an angular slit 52 or the like.

In FIG. 9 there is illustrated a modified half-glove portion 14' secured by means of stitches 26' to a garment of fabric material, such as is used in clothing, handbaggage and the like.

In FIG. 8 there is illustrated in phantom the half-mitten configuration 16' sewn to the posterior inner surface of a pair of jeans 10 and being accessible by means of angular slit 56.

In FIG. 10 there is illustrated the half-glove configuration sewn to the interior of a garment such as a blouse, skirt or pants, as illustrated in FIGS. 7, 8 and 9 and accessible by means of angular slot 54.

Manifestly, the half-glove or half-mitten configuration can be secured in various ways and to various types of clothing without departing from the spirit and scope of the claims.

We claim:

1. In a pants garment of the type adapted for covering the human form and including at least one conventional rear pocket, the improvement comprising a supplemental outer pocket which is conformed as a half glove upon a portion of the exterior garment surface which includes said rear pocket, said supplemental outer pocket being further defined by a sheet of material which is secured, at its edges, to said exterior surface portion to thereby define a hand-supporting concavity with respect to said exterior surface which defines the palm-engaging surface of the combination, wherein further the half-glove sheet material has an aperture defined to allow entrance and complete encircling of the fingers of a human hand which is placed therein, characterized in that said half-glove is angularly disposed with respect to said conventional rear pocket so as to allow a person other than the garment wearer to insert his or her hand while both are walking in a side-by-side fashion.

2. A pocket and supplemental pocket combination according to claim 1 wherein said supplemental pocket is conformed as a half-glove with articulate finger portions that are individually secured, at their edges, to the exterior of said conventional pocket to thereby define stalls with the exterior of said garment.

3. A pocket and supplemental pocket combination according to claim 2, wherein said articulate finger portions are further defined with open ends, whereby the fingers of a human hand within said hand engaging concavity are operable to extend outwardly, through said open ends, and against the exterior of said garment.

* * * * *